US012722095B2

(12) United States Patent
Patton

(10) Patent No.: US 12,722,095 B2
(45) Date of Patent: Sep. 1, 2026

(54) MODULAR DISPLAY SYSTEM

(71) Applicant: Killian Patton, Colorado Springs, CO (US)

(72) Inventor: Killian Patton, Colorado Springs, CO (US)

( * ) Notice: Subject to any disclaimer, the term of this patent is extended or adjusted under 35 U.S.C. 154(b) by 251 days.

(21) Appl. No.: 18/671,318

(22) Filed: May 22, 2024

(65) Prior Publication Data

US 2025/0360428 A1 Nov. 27, 2025

(51) Int. Cl.
*A63H 3/50* (2006.01)
*A47F 11/10* (2006.01)

(52) U.S. Cl.
CPC ..... *A63H 3/50* (2013.01); *A47F 11/10* (2013.01)

(58) Field of Classification Search
CPC . A63H 3/50; A47F 11/10; A47F 3/001; A47B 87/005; A47B 87/007; A47B 87/008; A47B 87/0276; A47B 87/0284; A47B 87/0292
See application file for complete search history.

(56) References Cited

U.S. PATENT DOCUMENTS 3,563,624 A * 2/1971 Stice ..... A47B 47/042 312/107
5,466,057 A * 11/1995 Blankenburg ..... A47B 87/005 312/111
5,775,046 A * 7/1998 Fanger ..... A47B 87/007 108/158.12
5,971,826 A * 10/1999 Delzompo ..... A47F 5/10 211/184
6,722,747 B2 4/2004 House, II et al.
7,311,202 B2 * 12/2007 Chen ..... A47B 87/0292 220/23.6
7,367,685 B2 * 5/2008 Moll ..... A47F 11/10 312/223.5
7,549,255 B2 * 6/2009 Kirkwood ..... A47B 87/005 52/79.5
7,789,470 B2 * 9/2010 McCabe ..... A47F 3/005 312/107

(Continued)

FOREIGN PATENT DOCUMENTS

EP 1277424 A1 * 1/2003 ..... A47F 11/10
WO WO-2013183328 A1 * 12/2013 ..... A63H 33/042
WO WO-2014207519 A1 * 12/2014 ..... G09F 19/18

*Primary Examiner* — Hanh V Tran
(74) *Attorney, Agent, or Firm* — Dale J. Ream

(57) ABSTRACT

A modular display system for the display of figurines includes a plurality of display cases, each case having multiple walls that, together, define an open front allowing access to an interior area. Each case includes a platform for supporting the figurine. The pair of side walls are selectively removable so that multiple display cases may be coupled together to form a larger display case. Side walls are connected to respective bottom and top walls using interlocking configurations. The modular display system includes upper and lower light bars coupled to top and bottom walls, respectively, each light bar selectively and removably including either a backlight or a black light and is angularly adjustable. Each display case includes an input port configured to receive electrical current and an output port configured to transmit electrical current such that electricity is transferable between adjacent display cases being coupled together.

6 Claims, 10 Drawing Sheets

(56) References Cited

U.S. PATENT DOCUMENTS

| | | | | |
|---|---|---|---|---|
| 7,967,401 | B2 * | 6/2011 | Hsu | A47B 47/0033 312/111 |
| 8,646,935 | B2 * | 2/2014 | Karan | A47B 96/061 362/240 |
| 8,857,088 | B1 | 10/2014 | Wheelis et al. | |
| 9,004,715 | B1 * | 4/2015 | Litke | A47F 3/001 362/218 |
| 9,510,678 | B2 * | 12/2016 | Aleisa | A47B 47/0091 |
| 9,936,826 | B2 * | 4/2018 | Agnoli | A47F 7/0078 |
| 10,068,501 | B2 * | 9/2018 | Conley | A47F 11/10 |
| 10,172,484 | B2 * | 1/2019 | Maldonado | A47F 7/06 |
| 10,533,737 | B1 * | 1/2020 | Dos Reis | A47B 63/00 |
| 10,860,275 | B1 * | 12/2020 | Luberto | A47F 7/281 |
| 11,063,631 | B2 * | 7/2021 | Visconti | H04B 3/542 |
| 11,384,926 | B2 * | 7/2022 | Zhang | F21V 17/105 |
| 11,937,711 | B1 * | 3/2024 | Reynolds, Jr. | A47F 3/001 |
| 2006/0207957 | A1 * | 9/2006 | Chen | A47B 47/0066 211/183 |
| 2009/0279295 | A1 * | 11/2009 | Van Der Poel | A47F 3/001 362/235 |
| 2013/0292351 | A1 * | 11/2013 | Wyatt | A47B 47/042 211/188 |
| 2014/0007471 | A1 * | 1/2014 | Ottolenghi | A47B 87/0292 264/219 |
| 2014/0340879 | A1 * | 11/2014 | Liu | A47F 3/001 362/125 |
| 2015/0321811 | A1 * | 11/2015 | Yeung | A47B 87/0284 220/23.83 |
| 2017/0055706 | A1 | 3/2017 | Mataxis | |
| 2018/0127150 | A1 * | 5/2018 | Adanur | B65D 21/0215 |
| 2021/0198936 | A1 * | 7/2021 | Mahmutyazicioglu | E05G 1/024 |
| 2023/0055111 | A1 * | 2/2023 | Peaple | A47F 5/08 |

* cited by examiner

MODULAR DISPLAY SYSTEM

BACKGROUND OF THE INVENTION

This invention relates generally to display cases and, more particularly, to a modular display system having a plurality of display cases that may be coupled together as a user's collection of pop-culture figurines is collected and displayed, each display case having at least one light bar that is selectively manipulated to cast backlight or black light onto the figurine.

In the realm of pop culture, there exists a vibrant and captivating phenomenon of collecting and displaying Funko characters. What began as a niche hobby has blossomed into a global sensation, drawing enthusiasts from all walks of life. Associated with these phenomena lies a trifecta of motivations including a love for the characters, a sense of community, and the allure of increasing value.

First, Funko pop collectors are driven by a passion for the characters that they collect. Whether it's iconic superheroes or brand-new caricatures, there is a Funko pop figure that is exciting to each respective collector. Second, Funko character collecting fosters a sense of community among enthusiasts. For instance, in online forums, social media groups, and local meet ups, collectors come together to share their collections with a sense of pride. Moreover, there is an allure to the increasing value of Funko pop-culture figurines. As certain figures become rarer or even discontinued, their market value can skyrocket, turning a once-trivial purchase into a lucrative asset.

An intriguing aspect of Funko figurine characters is the trend of showcasing the figures while still in the boxes, often utilizing backlights or black lights to create visually stunning arrangements. This practice not only preserves the condition of the figure but also allows collectors to craft elaborate and dynamic displays that elevate their collections into works of art. The interplay of light and shadow adds depth and drama to the presentation, transforming a simple shelf into a captivating showcase of pop-culture nostalgia.

Therefore, it would be desirable to have a modular display system for the sophisticated display of pop-culture figurines. Further, it would be desirable to have a modular display system having at least one display case having an open front that provides access to an interior area where a figurine may be supported upon a platform or riser and that includes lower and upper light bars that impart backlighting or black lighting to the figurine. In addition, it would be desirable to have a modular display system in which sidewalls may be selectively removable using interlocking configurations that enable creation of larger and wider display cases.

SUMMARY OF THE INVENTION

A modular display system according to the present invention for the display of an ornamental figurine includes a plurality of display cases, each display case including multiple walls that, together, define an open front allowing access to an interior area. Each display case includes a platform or riser for supporting the figurine. The pair of side walls are selectively removable so that multiple display cases may be coupled together to form a larger display case. Each sidewall is connected to respective bottom and top walls using interlocking dovetail structures. The modular display system includes an upper light bar coupled to an underside of the top wall and a lower light bar coupled to an upper side of the bottom wall. Each light bar selectively and removably includes either a backlight or a black light, each light bar being mounted at an adjustable angle for illuminating the figurine. Electrical wires and wire contacts extend between light bars and to a battery power source. Each display case includes an input port configured to receive electrical current and an output port configured to transmit electrical current such that electricity may be transferred between adjacent display cases being coupled together.

Therefore, a general object of this invention is to provide a modular display system for positioning and lighting at least one figurine.

Another object of this invention is to provide a modular display system, as aforesaid, in which multiple display cases may be coupled together and electrically energized together for the display of a plurality of figurines.

Still another object of this invention is to provide a modular display system, as aforesaid, in which each display case includes lower and upper light bars that may be angularly adjusted and electrically energized to illuminate a figurine.

A further object of this invention is to provide a modular display system, as aforesaid, in which electrical current may be transferred to downstream display cases that may be coupled together with interlocking fasteners.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

A modular display system according to a preferred embodiment of the present invention will now be described with reference to the accompanying drawings. The modular display system 10 includes a plurality of display cases 12 each having lighting components, removable walls that enable more complex display cases to be formed, and electrical components that enable downstream display cases to be illuminated.

Figure 9A:
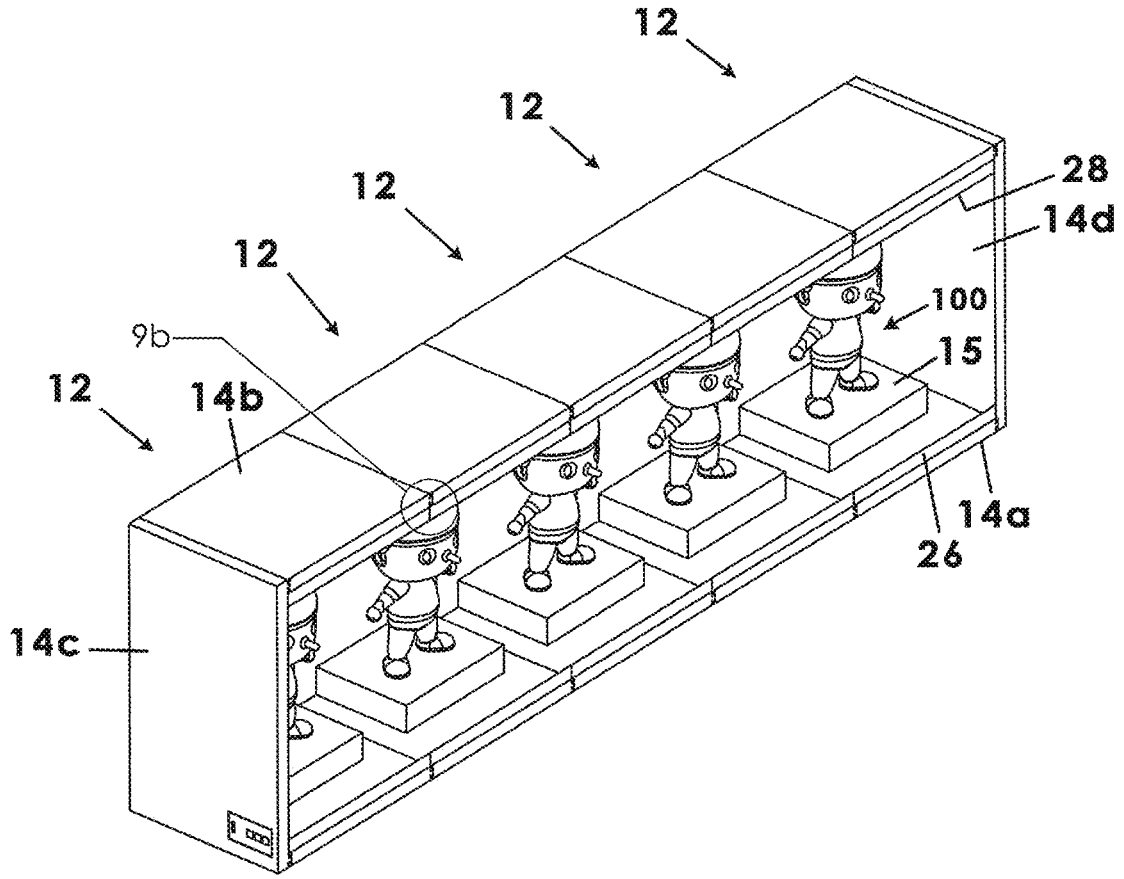
FIG. 9*a* is a perspective view of the modular display system according to the present invention, illustrated with a plurality of display cases coupled together in a side by side configuration.
Figure 9B:
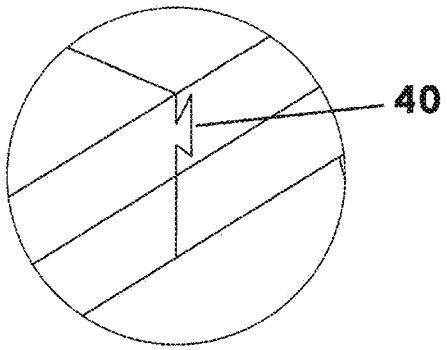
FIG. 9*b* is an isolated view on an enlarged scale taken from FIG. 9*a*.

The modular display system 10 includes a plurality of display cases 12. Each display case 12 includes a plurality of walls coupled together to completely encase a display area except for an open front area. More particularly, a display case 12 may include a bottom wall 14*a*, a top wall 14*b* opposite and parallel to the bottom wall, a left side wall 14*c* extending upwardly from a peripheral edge of the bottom wall 14*a*, a right side wall 14*d* opposite and parallel to the left side wall 14*c* (together, referred to as a pair of sidewalls), and a back wall 14*e* extending between the rear edges of the bottom wall 14*a* and top wall 14*b*, respectively and between rear edges of the left side wall 14*c* and right side wall 14*d*, respectively. Together, the plurality of walls describes a box that has a square or rectangular configuration and which defines an open front and an interior area. The open front provides access to the interior area and it is within said interior area that the figurine is to be displayed as will be described further later. In an embodiment, the open front may be constructed of a transparent plastic material so as to protect the figurine 100 from dust or just from being touched. Each of the pair of sidewalls may be removed such that the plurality of display cases 12 may be combined and arranged to form larger display cases, cases having a wider rectangular configuration, or the like (FIG. 9*a*) as will be described in more detail later.

Each display case 12 may include a platform or riser 15 mounted atop the upper surface of the bottom wall, the riser 15 having an overall dimension that is smaller than the bottom wall 14*a* itself and extends upwardly to define its own upper surface having a planar configuration. It is atop this riser 15 that the figurine 100 may be supported. In an embodiment, the riser 15 may be removably coupled to the bottom wall 14*a* so as to be replaceable.

Figure 5A:
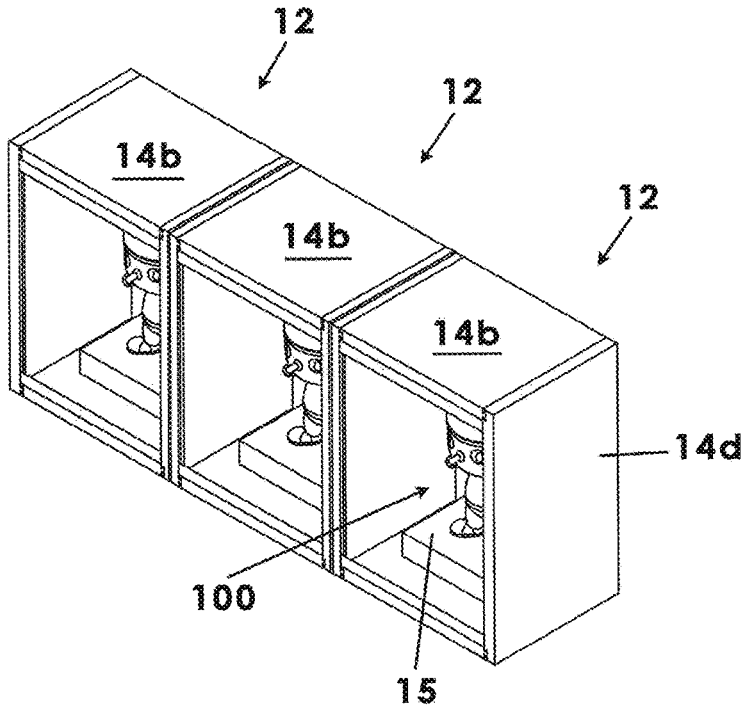
FIG. 5*a* is a perspective view of the modular display system according to the present invention, illustrated with 3 display cases coupled together and situated in a forward configuration.
Figure 5B:
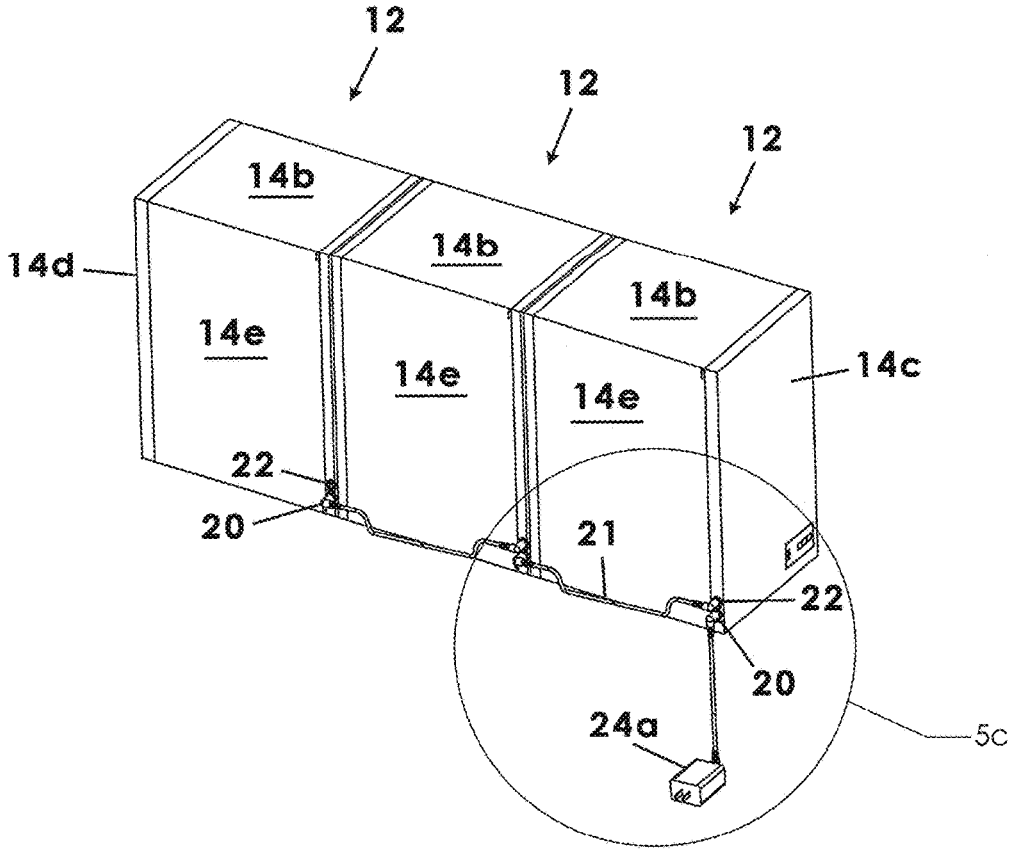
FIG. 5*b* is a perspective view of the modular display system as in FIG. 5*a*, illustrated in a backward configuration for clarity.
Figure 5C:
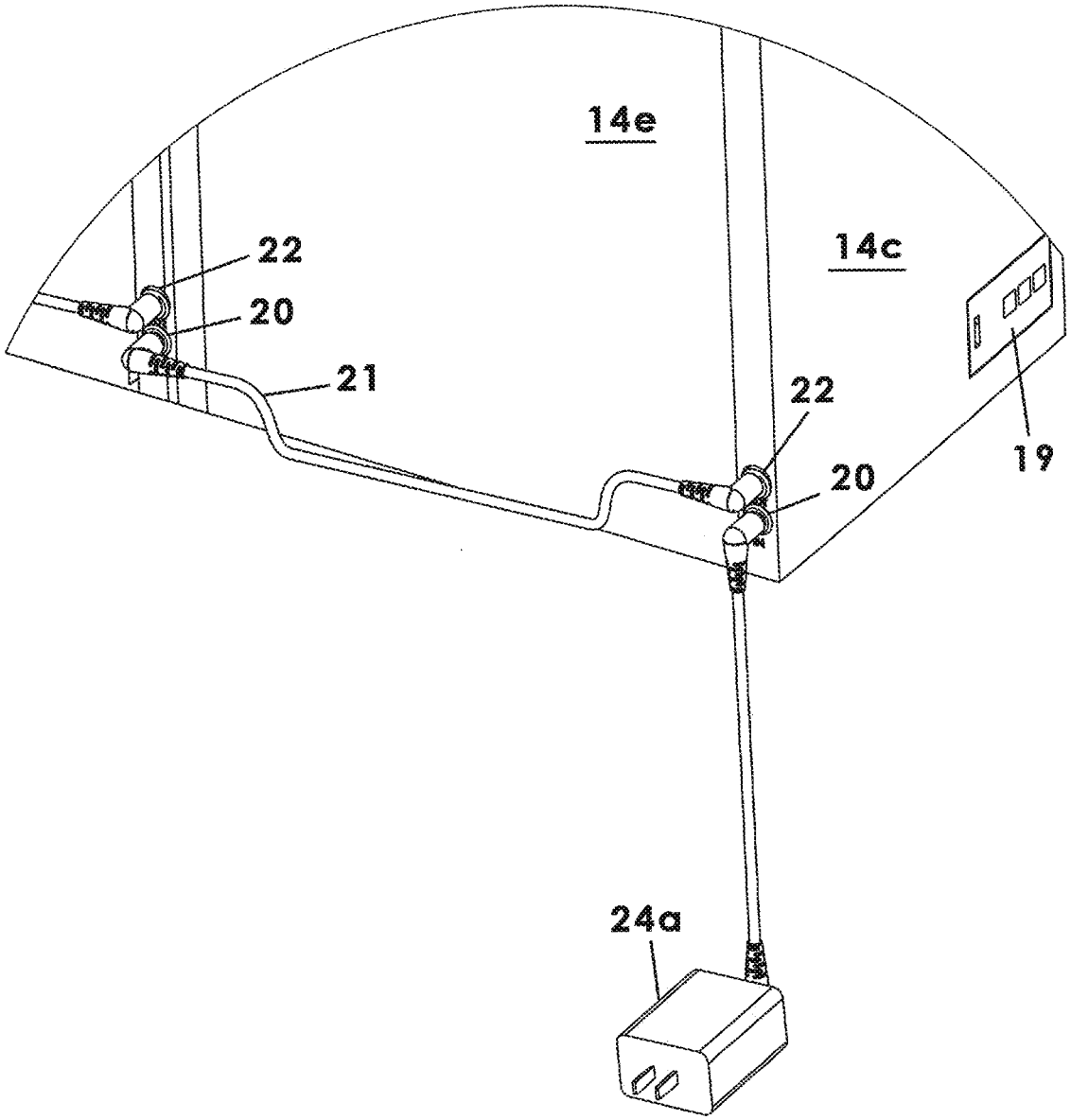
FIG. 5*c* is an isolated view on an enlarged scale taken from FIG. 5*b;*
Figure 6A:
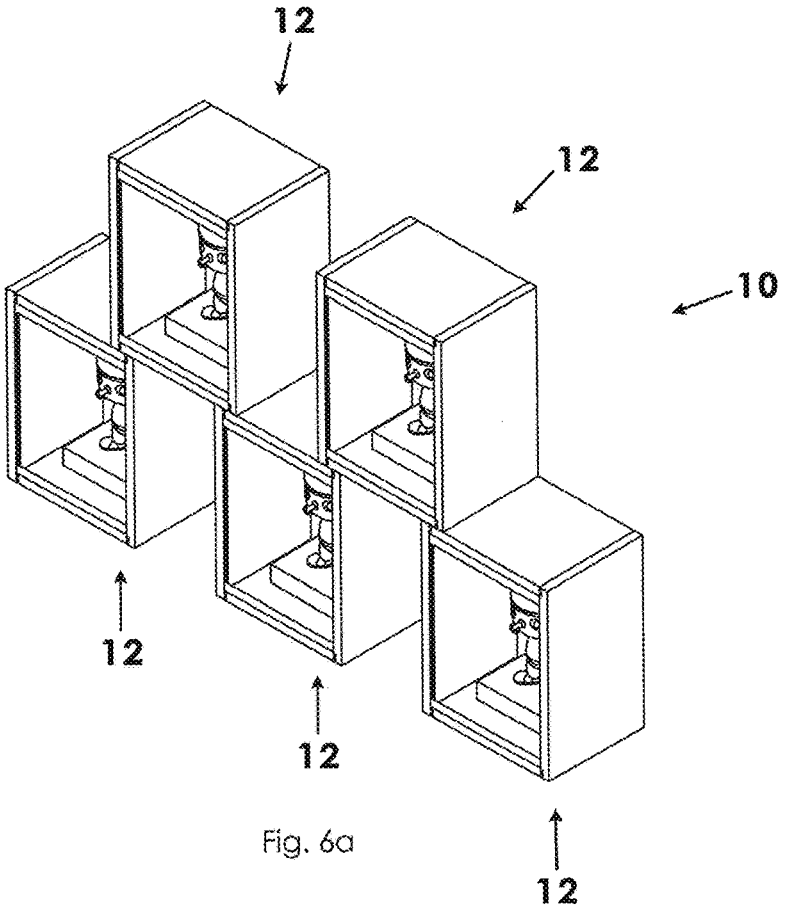
FIG. 6*a* is a perspective view of the modular display system according to the present invention, illustrated with a plurality of display cases organized in a partial pyramid configuration.
Figure 6B:
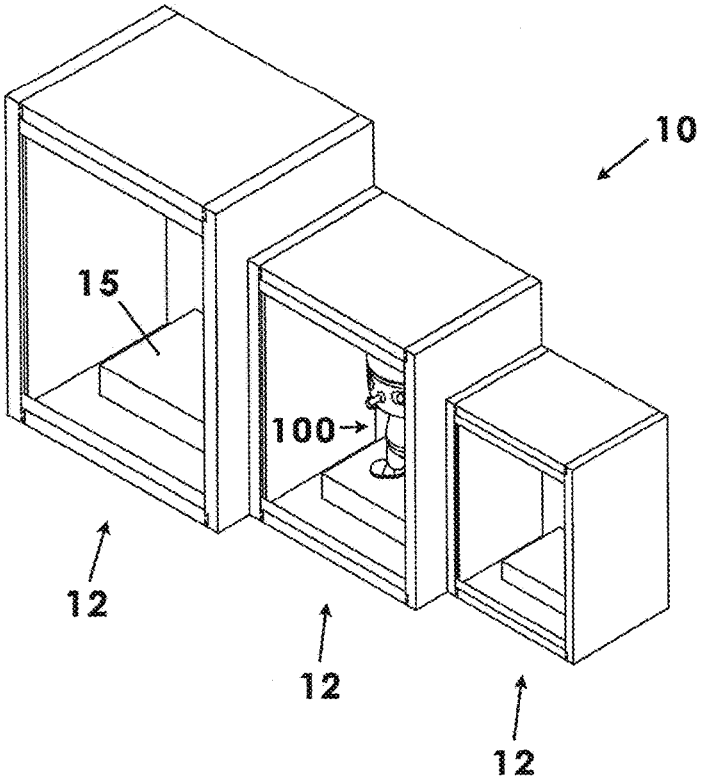
FIG. 6*b* is another perspective view of the modular display system according to the present invention, illustrated with display cases of different sizes.
Figure 7A:
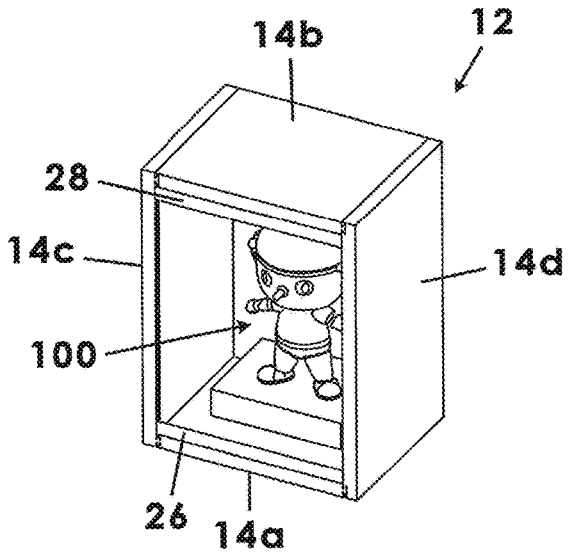
FIG. 7*a* is a perspective view of the display case as in FIG. 1.
Figure 7B:
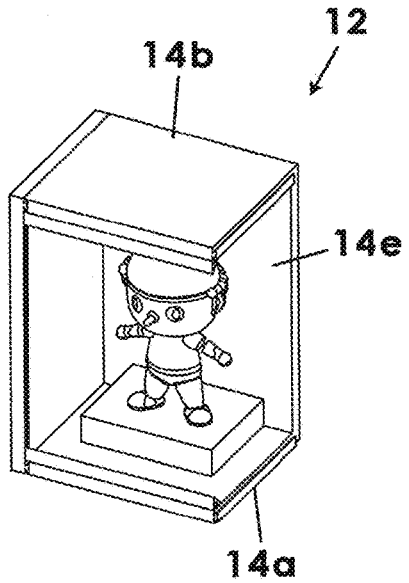
FIG. 7*b* is another perspective view of the display case as in FIG. 7*a*, illustrated with a right side wall removed.
Figure 7C:
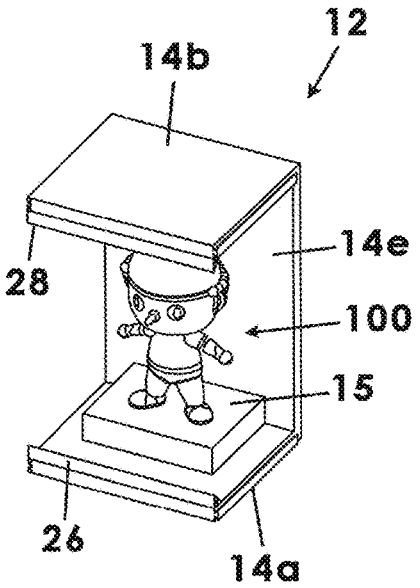
FIG. 7*c* is perspective view of the display case as in FIG. 7*b*, illustrated with both a left side and a right side wall removed.
Figure 7D:
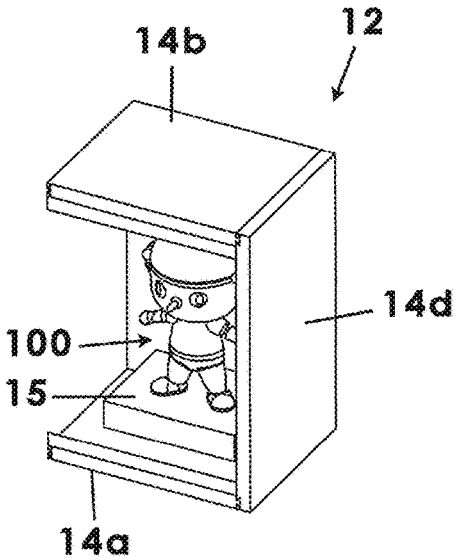
FIG. 7*d* is a perspective view of the display case as in FIG. 7*a*, illustrated with a left side wall removed.
Figure 8A:
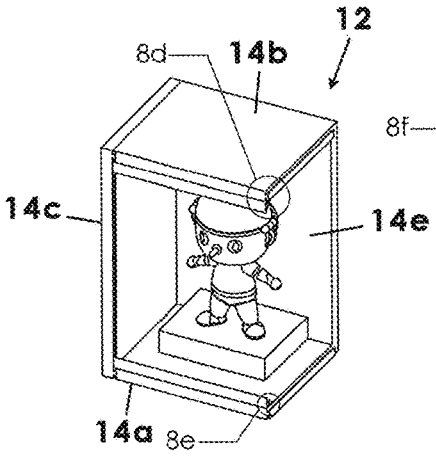
FIG. 8*a* is another perspective view of the display case as in FIG. 7*b;*
Figure 8B:
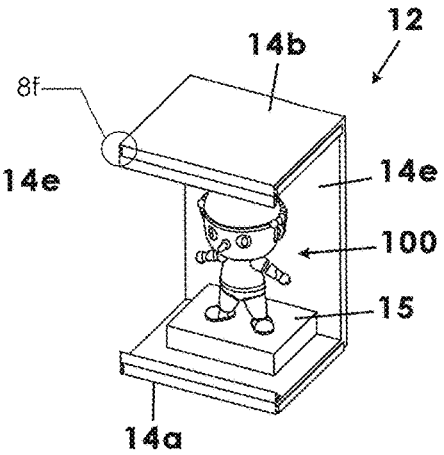
FIG. 8*b* is another perspective view of the display case as in FIG. 7*c;*
Figure 8C:
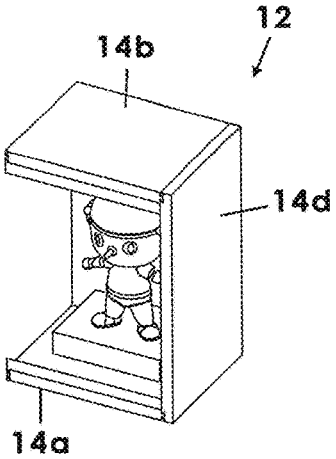
FIG. 8*c* is another perspective view of the display case as in FIG. 7*d;*
Figure 8D:
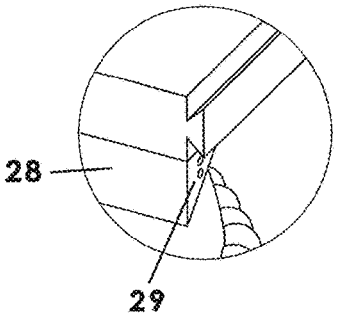
FIG. 8*d* is an isolated view on an enlarged scale taken from FIG. 8*a;*
Figure 8E:
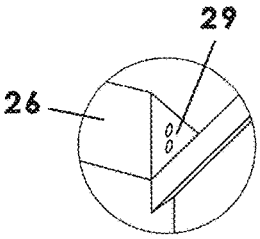
FIG. 8*e* is an isolated view on an enlarged scale taken from FIG. 8*a;*
Figure 8F:
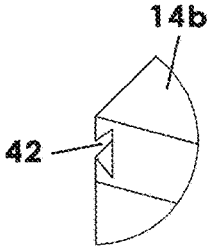
FIG. 8*f* is an isolated view on an enlarged scale taken from FIG. 8*b;*

Each display case 12 of the modular display system 10 includes an input port 20 that is configured to receive electrical current and an output port 22 that is configured to transmit or transfer electrical current. In use, electrical current from one display case 12 may be transmitted to a downstream display case where it is received by an input port 20 (FIG. 5*b*). Accordingly, electrical current may be passed through multiple display cases by stringing appropriate electrical cords between respective output ports 22 and input ports 20. Current may also be transferred by strategically placed electrical contacts as will be discussed later. In some display cases 12, the power source may be a battery 24 which may be in electrical communication with the input and output ports 20, 22 and also with the light bars disclosed below. The battery 24 and lighting controls may be mounted inside a battery box and inset into a sidewall of a display case 12 and referred to as a control panel 19 (FIG. 5*c*). In an embodiment, the power source may include AC current via an AC wall plug 24*a* configured to receive current into the input port 20.

Figure 1A:
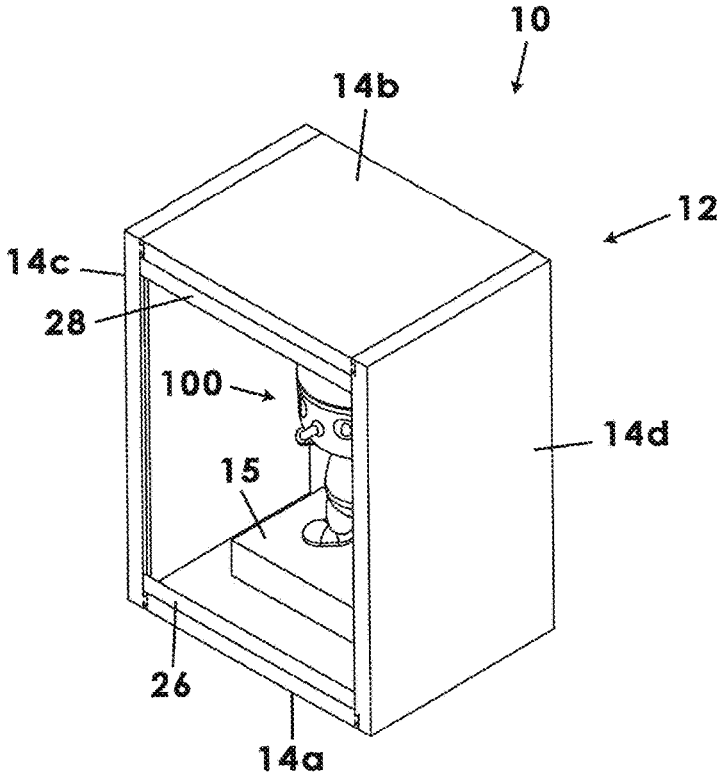
FIG. 1*a* is a perspective view of a modular display system according to a preferred embodiment of the present invention, the system illustrated with only a single display case set in a forward configuration.
Figure 1B:
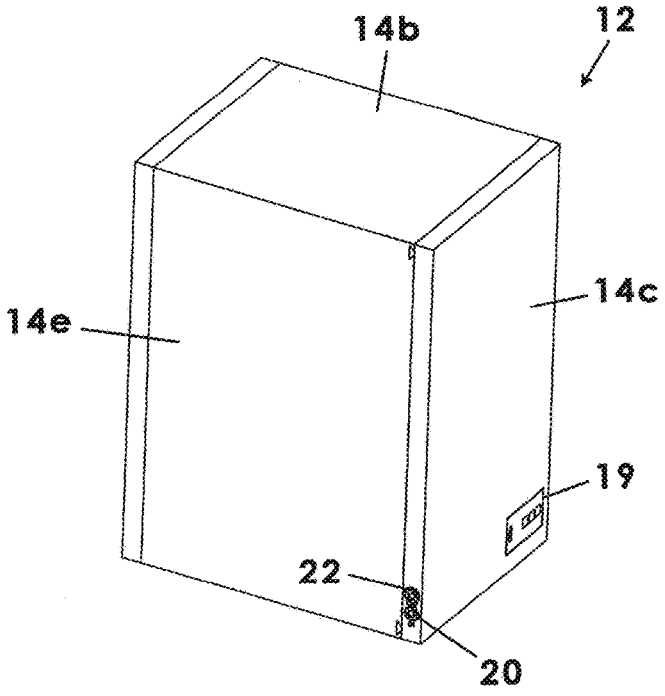
FIG. 1*b* is another perspective view of the display system according to the present invention, illustrated with the single display case set in a backward configuration.
Figure 2A:
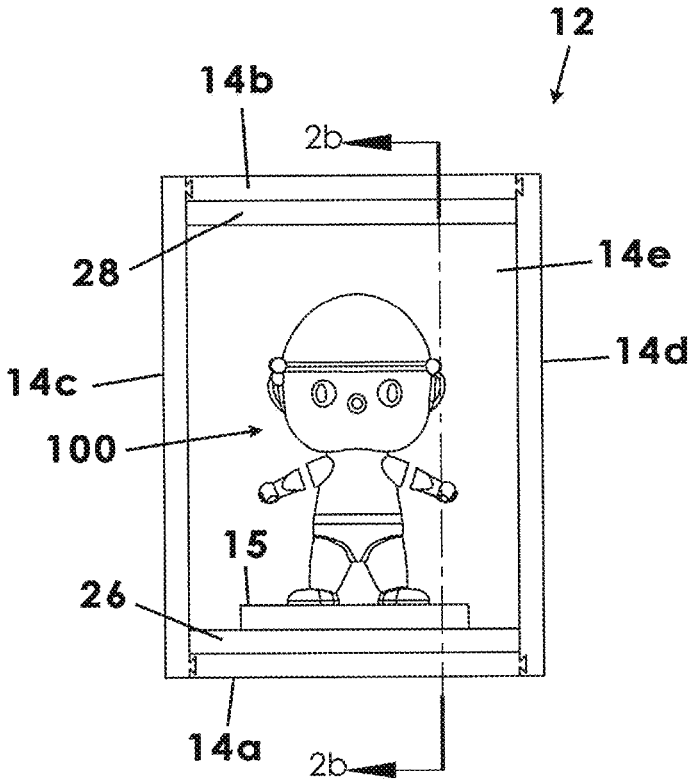
FIG. 2*a* is a front view of the display case as in FIG. 1*a* taken along line 2*b*-2*b* of FIG. 2.
Figure 2B:
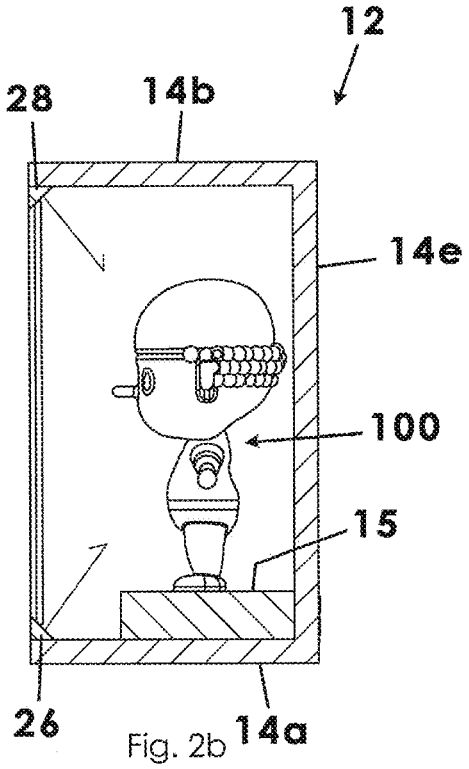
FIG. 2*b* is a sectional view of the display case.
Figure 3:
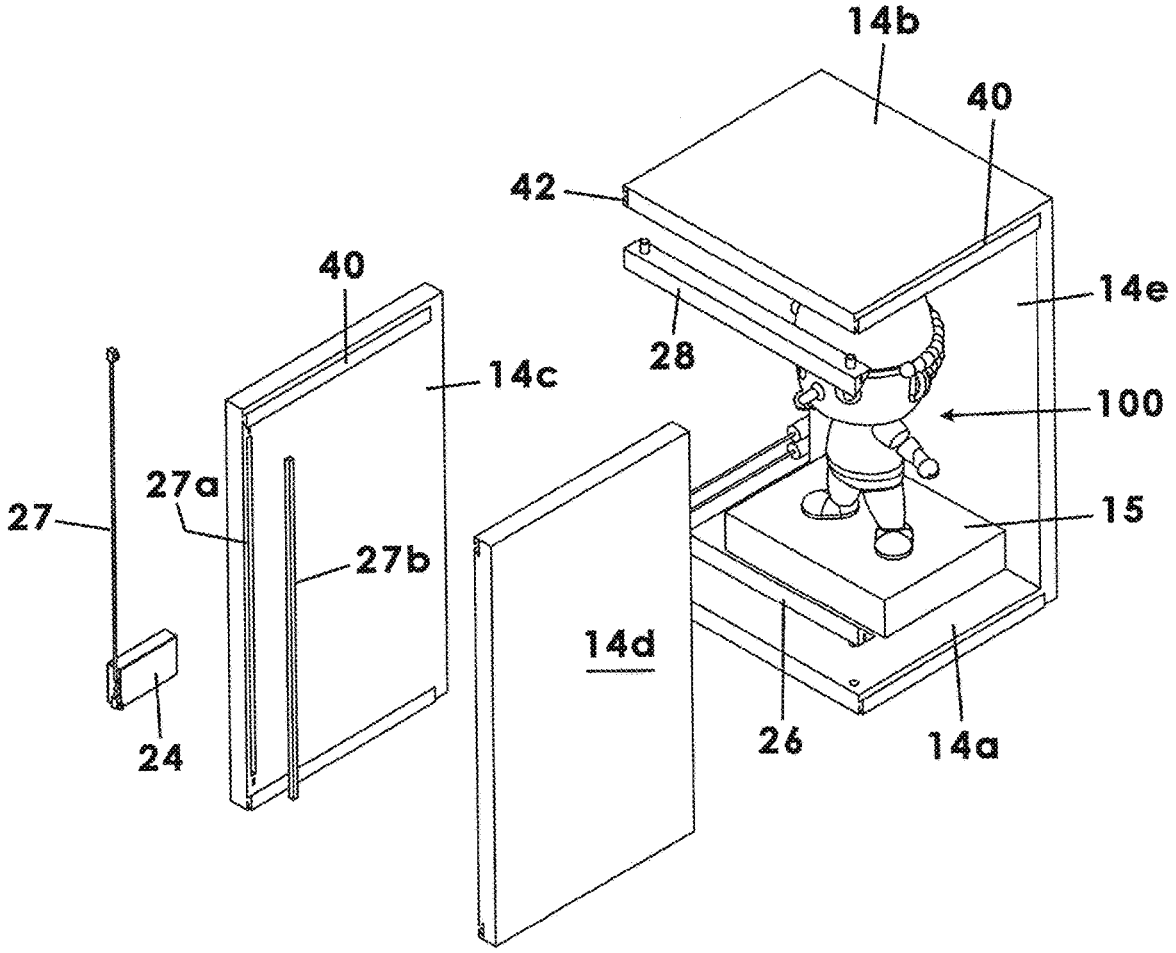
FIG. 3 is an exploded view of the display case as in FIG. 1*a;*
Figure 4:
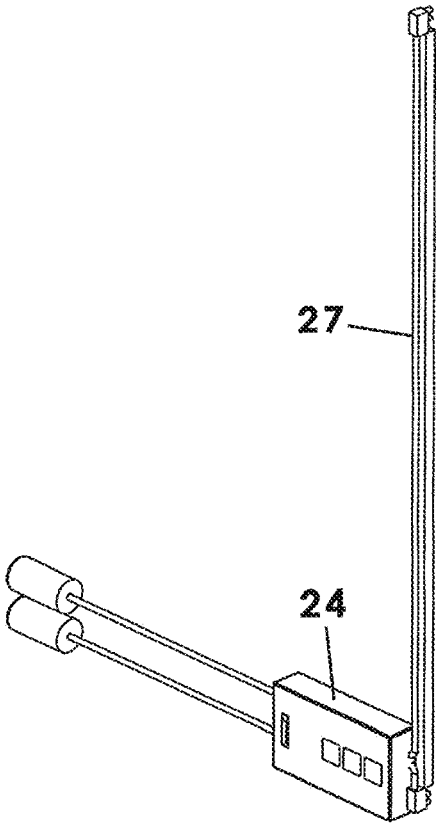
FIG. 4 is a perspective view of a battery and electrical wire according to the present invention.

Further, each display case 12 may include a lower light bar 26 mounted proximate a front edge of the bottom wall 14*a* having at least one light source configured to illuminate the interior area when energized. In an embodiment, the lower light bar 26 may include a pair of friction-fit mounting pins (FIG. 3) received into complementary holes in an upper surface of the bottom wall 14*a*. Preferably, the lower light bar 26 is angled so as to illuminate the figurine 100 within the interior area and may be angularly adjustable. Similarly, each display case 12 may include an upper light bar 28 mounted proximate a front edge of the top wall 14*b* having at least one light source configured to illuminate the interior area when energized. In an embodiment, the upper light bar 28 may include a pair of friction-fit mounting pins received into complementary holes in a lower surface of the top wall 14*b*. Preferably, the upper light bar 28 is angled so as to illuminate the figurine 100 within the interior area and may be angularly adjustable.

In an embodiment, the light source may be a light that provides backlighting or, in another embodiment, may include a black light. Black light is a type of ultraviolet light that emits ultraviolet radiation in the UVA band and has the effect of making certain materials glow. For instance, the figurine 100 may represent a sinister character or may be wearing clothing that would be more entertaining when viewed under black light. It will be understood that the type of light may be removable and replaceable or perhaps both lights are included and may be toggled with a switch.

In an embodiment, the light bars 26 and 28 may be electrically connected such as with a wire 27 and the wire 27 may be electrically connected to the battery 24 which supplies current to the light bars. Further, an inner surface of a left side wall 14*c* may define a groove 27*a* into which the wire 27 may be nested. A groove cover 27*b* may also be included and may snap-fit into the groove 27*a*. In a critical aspect, opposite ends of each light bar may include electrical contacts 29 configured to transfer electrical current to an adjacent downstream display case 12. More particularly, the electrical contacts 29 enable adjacent light bars to share electrical current sufficient to be energized. In a similar embodiment, the electrical contacts may be situated at lateral edges of respective bottom walls 14*a*, i.e., at each joint or connection between laterally adjacent display cases 12 to enable multiple display cases 12 to be energized together.

In another critical aspect, the pair of sidewalls may be removably coupled to the bottom wall 14*a* and top wall 14*b* via interlocking constructions. As shown, an upper edge of the right-side wall 14*d* may include male dovetail protrusions 40 and a left edge of the top wall 14*b* includes female dovetail structures 42 that are complementary to the male dovetail protrusions 40. It is understood that the right edge of the top wall 14*b* and left edge of the top wall 14*b* include similar complementary interlocking structures. It is also understood that the bottom edges of the pair of sidewalls and edges of the bottom wall 14*a* may include interlocking dovetail structures in the manner described above. Accordingly, it is understood that the interlocking dovetail configurations enable the pair of sidewalls to be selectively and slidably connected to the bottom and top walls of each display case 12

It is understood that while certain forms of this invention have been illustrated and described, it is not limited thereto except insofar as such limitations are included in the following claims and allowable functional equivalents thereof.

The invention claimed is:

1. A modular display system for the display of at least one figurine, comprising:

a plurality of display cases, each display case including a bottom wall, a top wall opposite said bottom wall, a pair of side walls that are positioned opposite one another and extend between lateral edges of said bottom and top walls, respectively, and a back wall extending between opposed rear edges of said bottom, top, and said pair of side walls, respectively, wherein said bottom, top, side and back walls, together, define an open front and an interior area;

wherein said each display case includes an input port configured to receive electrical current from an upstream display case and an output port configured to transmit electrical current to a downstream display case;

a lower light bar coupled to said bottom wall and positioned in said interior area, said lower light bar being electrically connected to said input port;

an upper light bar coupled to said top wall and positioned in said interior area, said upper light bar being electrically connected to said input port; and a platform situated atop said lower wall in said interior area, said platform having an upper surface having a planar configuration configured to support the figurine;

said pair of side walls includes a left sidewall and a right sidewall;

a top edge of said left side wall and a left side edge of said top wall include interlocking dovetail configurations such that said left side wall is removably coupled to said top wall;

a top edge of said right sidewall and a right-side edge of said top wall include interlocking dovetail configurations such that said right side wall is removably coupled to said top wall;

said left side edge of said top wall includes electrical contacts in electrical communication with said upper light bar;

said right side edge of said bottom wall includes electrical contacts in electrical communication with said lower light bar.

2. The modular display system as in claim 1, wherein each side wall of said pair of side walls is removably coupled to said top and bottom walls, respectively.

3. The modular display system as in claim 1, wherein said left sidewall defines a control box and a battery situated therein that is in electrical communication with said input port.

4. The modular display system as in claim 1, wherein said lower light bar includes at least one of a black light or a backlight.

5. The modular display system as in claim 1, wherein sa id upper light bar includes at least one of a black light or a backlight.

6. The modular display system as in claim 3, wherein:

said lower light bar is electrically connected to said battery and to said upper light bar with a light bar wire; and an inner surface of said left sidewall defines a groove into which said light bar wire is nested.

* * * * *